United States Patent [19]

Yearout

[11] 4,308,043

[45] Dec. 29, 1981

[54] PRODUCTION OF OXYGEN BY AIR SEPARATION

[76] Inventor: James D. Yearout, 270 Portofino Way #303, Redondo Beach, Calif. 90277

[21] Appl. No.: 178,296

[22] Filed: Aug. 15, 1980

[51] Int. Cl.[3] ..... F25J 3/04

[52] U.S. Cl. ..... 62/13; 62/18; 62/29; 62/38

[58] Field of Search ..... 62/13–15, 62/18, 28–29, 38, 39

[56] References Cited

U.S. PATENT DOCUMENTS

| | | | |
|---|---|---|---|
| 1,970,299 | 8/1934 | Frankl | 62/29 |
| 2,817,215 | 12/1957 | Sixsmith | 62/29 |
| 2,850,880 | 9/1958 | Jakob | 62/39 |
| 3,257,814 | 6/1966 | Carbonell | 62/39 |
| 3,535,887 | 10/1970 | Hoffman | 62/38 |

*Primary Examiner*—Norman Yudkoff
*Attorney, Agent, or Firm*—Max Geldin

[57] ABSTRACT

Production of oxygen by compressing air to about 3 atmospheres, and passing the compressed air to a reversing heat exchanger in heat exchange relation with a nitrogen waste stream wherein a 3° R temperature difference between the streams prevails at the cold end. Water vapor and $CO_2$ are frozen out. Reversal of the flow stream causes sublimation or evaporation of the $CO_2$ and water vapor. A portion of the air is withdrawn at an intermediate point in the exchanger and is further cooled in the lower portion of a non-adiabatic fractionating device wherein it is partly condensed by evaporating oxygen liquid product. The condensed air is then fed to the partial condensing zone of the fractionating device, whereby oxygen-rich liquid is condensed and overhead nitrogen is turbine expanded and passed in countercurrent heat exchange relation to the partial condensing zone. The oxygen-rich liquid, reduced in pressure to about 1 atmosphere, is fed to the partial evaoration zone of the fractionating device to remove nitrogen-rich vapor as overhead, and obtain oxygen of about 95% purity which is passed through a separate passage of the reversing exchanger.

27 Claims, 5 Drawing Figures

PRODUCTION OF OXYGEN BY AIR SEPARATION

BACKGROUND OF THE INVENTION

This invention relates to the separation of oxygen from air by rectification, and is particularly concerned with improved procedure for the separation of oxygen from air employing a nonadiabatic air fractionating system, in conjunction with a reversing heat exchanger for removal of water vapor and carbon dioxide, from the feed air.

In the prior art for production of oxygen and nitrogen from air, carbon dioxide and water vapor have been removed from the feed air by external means, such as molecular sieves, as exemplified by U.S. Pat. No. 3,594,983. However, molecular sieves used for this purpose are bulky, heavy and relatively expensive.

In U.S. Pat. No. 3,508,412 for production of nitrogen by air separation, compressed air is cooled in a regenerative cooler in countercurrent heat exchange relation with oxygen-rich vapor and nitrogen.

The most economical method for removing carbon dioxide and water vapor from the feed air is to deposit the $CO_2$ and water vapor, in solid form on the surface of the regenerative heat exchanger, and, by reversing the flow passages between the incoming feed air and the low-pressure nitrogen waste stream, these contaminants are sublimated off the heat exchange surface into vapor phase. However, such regenerative heat exchangers have generally been employed with a high feed air pressure, e.g. of the order of about 10 atmospheres.

It is an object of the present invention to provide a process and system to separate oxygen from air by rectification while reducing power consumption as low as possible, by reducing the pressure of the feed air, preferably to about 3 atmospheres, or less.

Another object is to employ reversing heat exchangers for carrying out water vapor and carbon dioxide removal from the feed air at pressures at or below 3 atmospheres.

Another object is to carry out separation of oxygen from air using reversing heat exchangers in conjunction with an air fractionation system, for removal of carbon dioxide and water vapor while maintaining an air feed pressure of not more than about 3 atmospheres.

Yet another object is to enable production of both liquid and gaseous oxygen product, while still maintaining air purification employing the above process and system utilizing reversing heat exchangers.

SUMMARY OF THE INVENTION

It has been found that the ability of the nitrogen-rich waste stream to carry off the $CO_2$ and water vapor contamination from the feed air employing a reversing regenerator, in a process of the type disclosed in U.S. Pat. No. 3,508,412, employing differential distillation for separating air, depends upon two factors: namely the pressure difference between the incoming air and the nitrogen-rich waste stream and (2) the temperature difference between these two streams.

As the feed air pressure is reduced, resulting in lower energy consumption, the temperature difference between the above two streams at the cold end of the heat exchanger become more critical to enable removal of $CO_2$ and water vapor. As the feed air pressure is reduced, the temperature differential between the feed air and the waste stream at the cold end of the reversing regenerator must be very carefully controlled.

This in turn requires that the heat and mass transfer relationships within the zone of the fractionating system be very carefully arranged so that the temperature difference between the feed air and the returning nitrogen waste stream and oxygen product stream, is very small, that is 3° R. at 3 atmospheres pressure.

According to the present invention, production of oxygen from air is carried out by compressing air, e.g. to about 3 atmospheres, and passing the compressed feed air to alternate passages of a reversing heat exchanger in heat exchange relation with a nitrogen waste stream, whereby water vapor and $CO_2$ in the feed are frozen on the surface of the heat exchange passage. By reversing flow streams so that the low pressure nitrogen waste stream now flows through the feed air passage, this causes sublimation and evaporation of the $CO_2$ and water vapor.

In preferred operation, a portion of the feed air is withdrawn at an intermediate point in the reversing exchanger and is further cooled in the lower portion of a fractionation device. The main air stream passing through the heat exchanger is mixed with the cooled feed air portion exiting the fractionation device, and the resulting mixture is fed through a first fractionation zone of a non-adiabatic fractionating device for carrying out a differential distillation, whereby oxygen-rich liquid is condensed and withdrawn from such initial fractionation zone operating at the feed air pressure, e.g. about 3 atmospheres, and nitrogen is withdrawn as overhead.

The oxygen-rich liquid is reduced in pressure to about 1 atmosphere and is fed to a second low pressure fractionation zone in heat exchange relationship with the first fractionating zone, and in which the oxygen-rich liquid is partially evaporated and a liquid bottoms product of relatively pure oxygen is obtained. Partial evaporation of the liquid in the second low pressure zone assists in the partial condensation of liquid in the high pressure zone.

The nitrogen withdrawn from the overhead of the first high pressure zone is expanded through a turbine and passed in countercurrent heat exchange relationship with the fractionating zones, thereby providing the necessary additional refrigeration for the partial condensation of the oxygen-rich liquid in the initial fractionation zone. The relatively pure oxygen liquid withdrawn from the bottom of the low pressure fractionating zone may be withdrawn from the system, whether as liquid or evaporated by partial condensation of a small portion of the air feed introduced into the first fractionating zone of the fractionation device. The waste nitrogen stream finally exiting the heat exchange passage of the fractionating device is passed through a reversing passage of the reversing heat exchanger. The gaseous oxygen product stream is passed through a separate non-reversing passage of the reversing heat exchanger.

The fractionator process is carried out so that there is only about a 3° R. temperature difference between both the waste nitrogen stream and the oxygen product stream, and the feed air at the cold end of the reversing heat exchanger.

On the other hand, in the process of my above U.S. Pat. No. 3,508,412 the nitrogen enters the regenerative cooler approximately 10° R. below the dew point of the feed air.

Additionally, the system may be modified to withdraw as pure product both oxygen and some amount of gaseous nitrogen so long as there is a sufficient volume of waste nitrogen gas passing through the reversing passages of the heat exchanger to effect complete sublimation of the deposited carbon dioxide and water vapor. The volume of waste stream when both nitrogen and oxygen are withdrawn as product must be in excess of 50% of the total volume of the feed air stream.

That portion of the feed air which is removed at an intermediate point in the reversing regenerative heat exchanger is tapped from the exchanger at a point upstream or above the cold end of the exchanger, thereby creating a mass imbalance in the cold portion of the exchanger. This creates a temperature pinch ($\Delta T$) at the cold end of the exchanger, thereby insuring complete sublimation of the solid $CO_2$ from the feed when the waste nitrogen and the feed air passages are reversed to permit the waste stream to pass through the passages previously occupied by the feed stream.

On the other hand, when employing higher feed pressures of the order of 8 atmospheres, e.g. as in the above U.S. Pat. No. 3,508,412, the temperature difference between the feed air and the separated streams passing through the regenerative cooler must be less than 8° R., in order for reversing exchangers to function. If the temperature difference between the incoming air stream, and the nitrogen product and oxygen-rich waste streams at the cold end of the reversing regenerator is greater than 3° R., when operating at a feed pressure of 3 atmospheres, using the process of the above patent, the waste stream will not pick up and remove the $CO_2$, which would plug the regenerator. These relationships are illustrated in FIG. 1 of the drawing.

The process for the separation of oxygen from air, according to the invention basically comprises:

compressing feed air containing water vapor and $CO_2$, to relatively low pressure, passing the compressed feed air stream through a first passage of a reversing heat exchanger in heat exchange relation with a nitrogen waste stream passing through a second passage of said heat exchanger, whereby water vapor and $CO_2$ in the feed air are frozen on a surface of said first heat exchange passage, reversing the two streams whereby the nitrogen waste stream flows through said first passage and said feed air stream flows through said second passage, causing sublimation or evaporation of said water vapor and said $CO_2$, at the end of this cycle, again reversing the two streams so that the compressed feed air stream passes through said first passage and the nitrogen waste stream passes through said second passage, and repeating the cycle at predetermined intervals, withdrawing a portion of the feed air stream at an intermediate point in the heat exchanger, further cooling said withdrawn portion of feed air in heat exchange relationship within a fractionating device, withdrawing the remainder of said cooled feed air stream from the cold end of said heat exchanger after complete passage therethrough, mixing said further cooled portion of feed air and said withdrawn remainder of cooled feed air stream, passing said cooled feed air mixture through a first fractionating zone in said fractionating device, whereby oxygen-rich liquid is condensed, and a nitrogen overhead is produced.

withdrawing said oxygen-rich liquid from said first fractionating zone, throttling said withdrawn oxygen-rich liquid to lower pressure, passing said throttled liquid downward in a second fractionating zone in said fractionating device, whereby nitrogen vapor is formed and oxygen-rich liquid product is produced.

withdrawing said oxygen-rich liquid as product from said second fractionating zone work expanding nitrogen overhead from said first fractionating zone and discharging cooled nitrogen at reduced pressure, passing said cooled work expanded nitrogen through a passage in said fractionating device in heat exchange relation with said second fractionating zone and withdrawing heat from said zone, withdrawing said nitrogen from said last mentioned passage in said fractionating device and passing said withdrawn waste nitrogen stream into the cold end of said heat exchanger through one of said first and second passages of the reversing heat exchanger as aforesaid.

said heat exchange in said reversing heat exchanger and the fractionation in said fractionating device being carried out under conditions such that there is only a small temperature difference between the waste nitrogen stream entering the cold end of said exchanger and the cooled feed air stream withdrawn from the cold end of the heat exchanger.

Where at least a portion of the oxygen-rich liquid product withdrawn from the second fractionating zone is to be recovered as gaseous oxygen, the feed air mixture, prior to passage through the first fractionating zone, is further cooled in heat exchange relation with such portion of oxygen-rich product, causing evaporation of gaseous oxygen from such product. Such gaseous oxygen can then be passed through a third passage of the reversing heat exchanger in heat exchange relation with the feed air stream.

THE DRAWINGS

Figure 1:
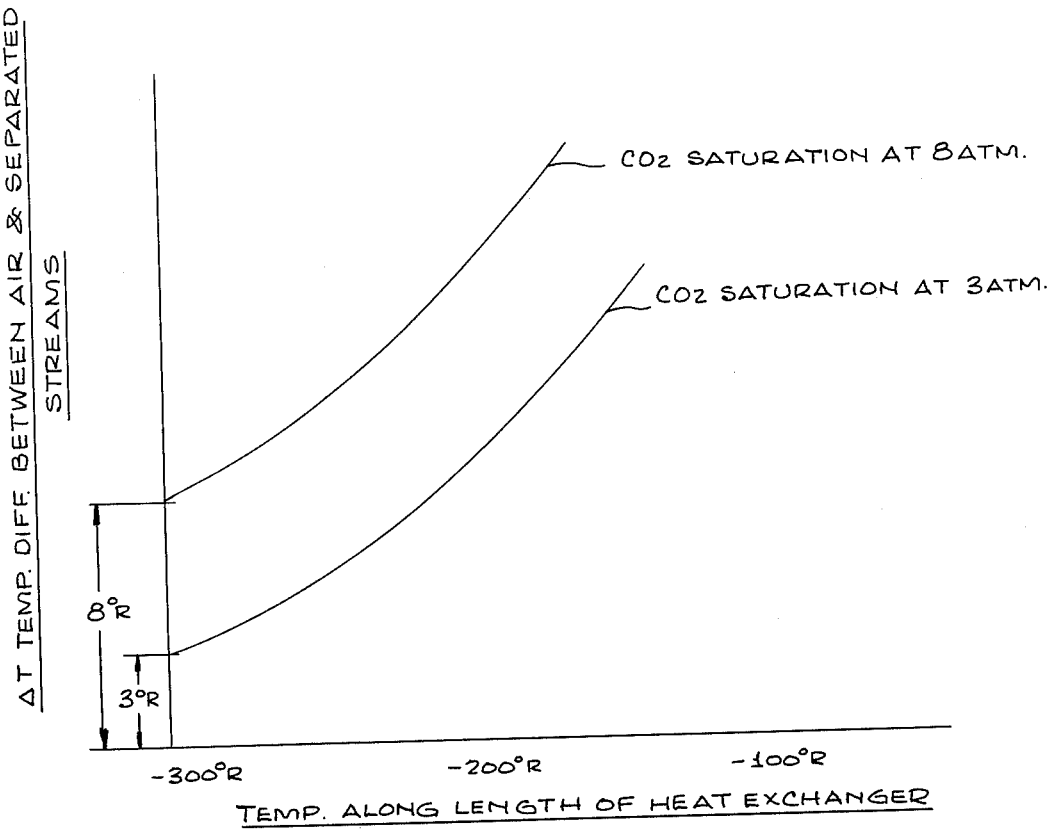
FIG. 1 shows the temperature difference between the feed air stream and the separated streams including the nitrogen waste stream along the length of the reversing heat exchanger.
Figure 2:
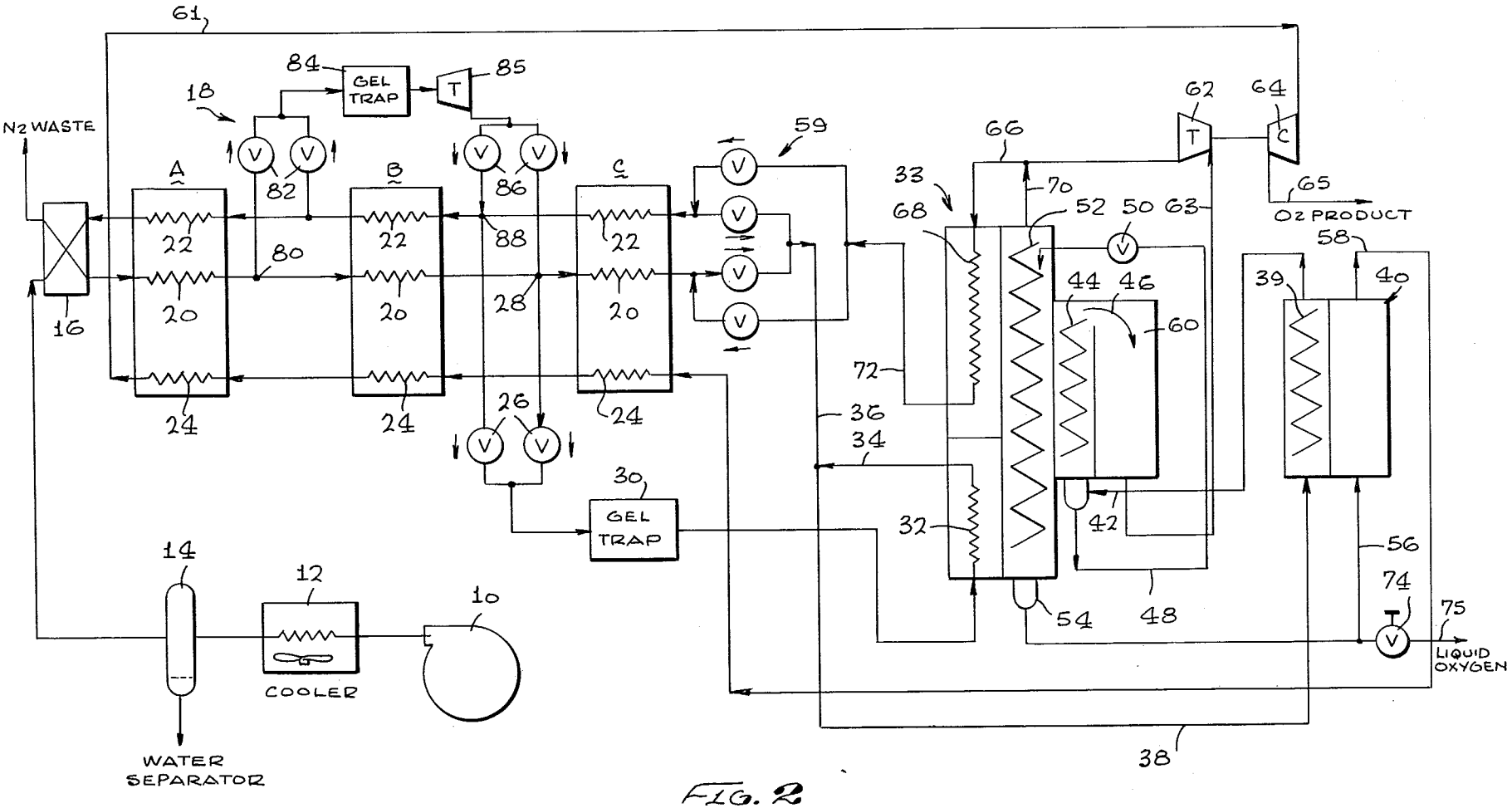
FIG. 2 is a schematic flow diagram of a preferred mode of operation.
Figure 2:
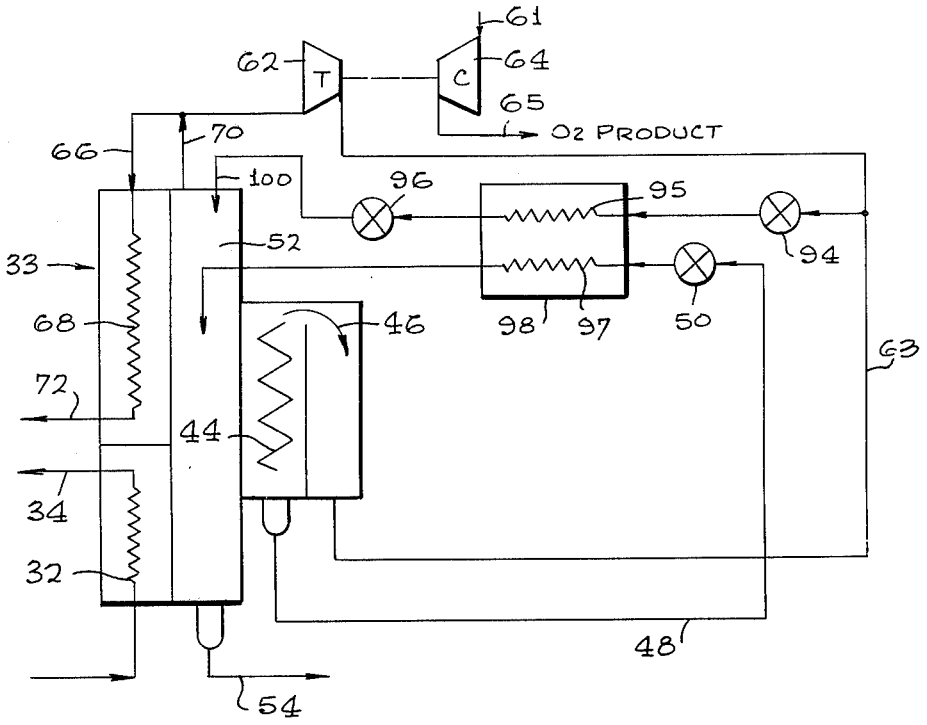
Figure 2A:
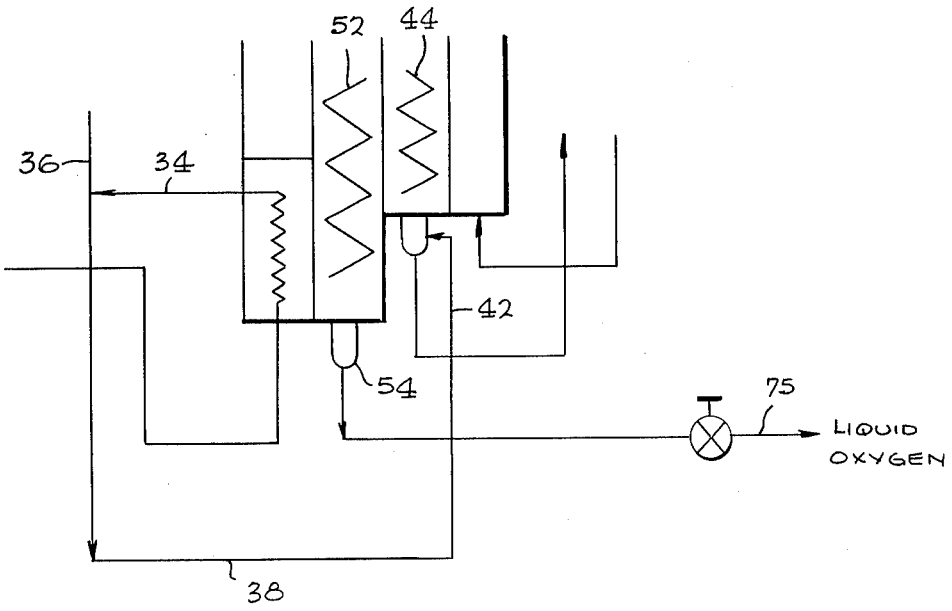
Figure 3:
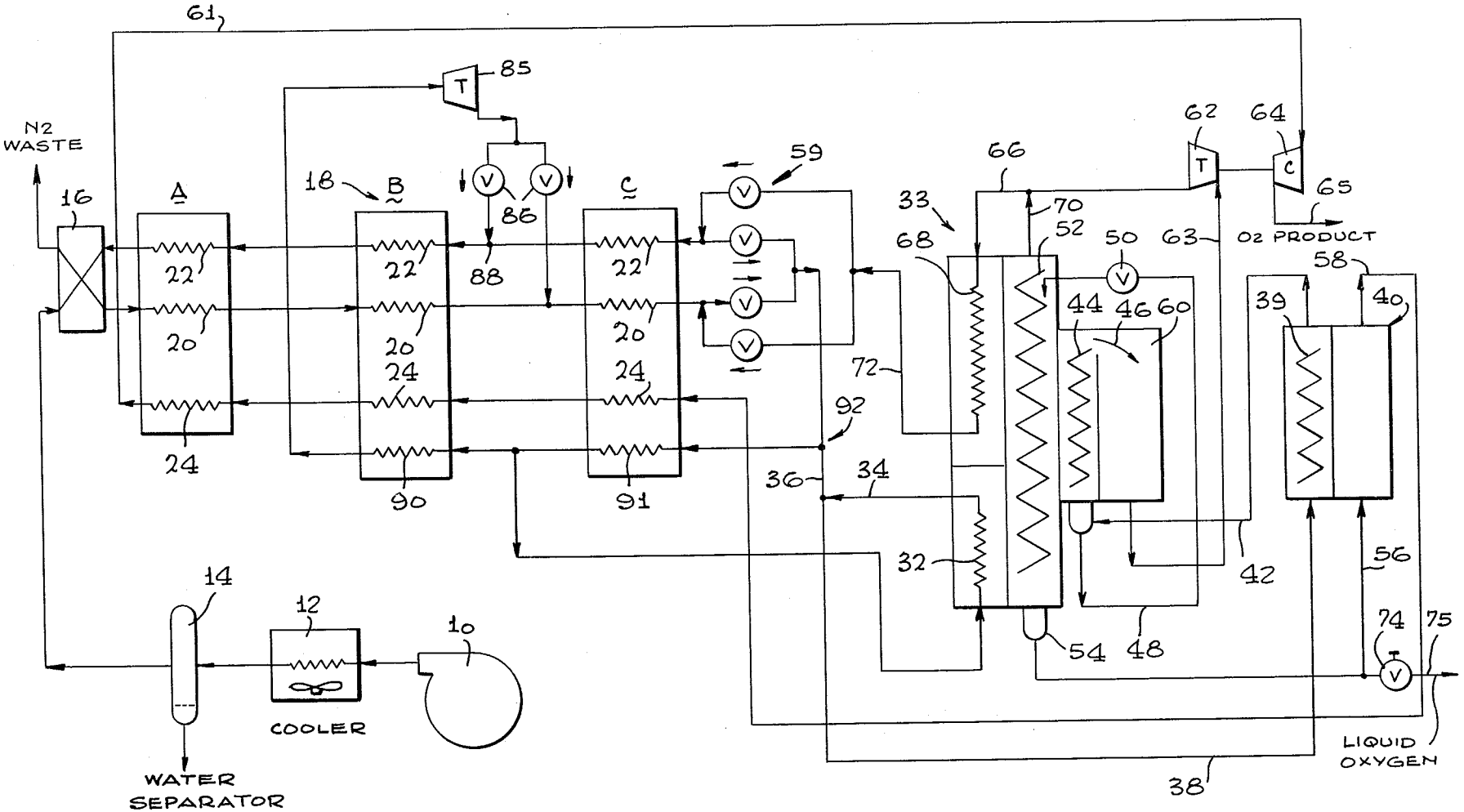

FIG. 2*a* is a modification of the system illustrated in FIG. 2, for production of oxygen-rich liquid alone as product;

FIG. 3 is a further modification of the system of FIG. 2, illustrating a reversing heat exchanger using a Trumpler pass instead of gel traps; and FIG. 4 is another modification of the system illustrated in FIG. 2, for increasing total oxygen product recovery.

DETAILED DESCRIPTION OF THE INVENTION AND PREFERRED EMBODIMENTS

Referring to FIG. 2 of the drawing, air is compressed at 10 to about 3 atmospheres, cooled to near ambient temperature at 12 and free water is separated in a separator at 14. The air feed then enters a reversing regenerative heat exchanger, indicated generally at 18, through a reversing valve 16, which is connected to two passages 20 and 22 of the reversing regenerative heat exchanger 18, comprised of three units A, B, and C. The heat exchanger contains heat exchange passages 20 for feed air and 22 for the waste nitrogen, and also a heat exchange passage 24 for oxygen product.

Reversing valve 16, together with the check valve assemblies such as 26, described more fully hereinafter, cause the feed air at 3 atmospheres in passage 20 to alternate passages with the nitrogen waste stream, which is at one atmosphere, in passage 22. As the feed air in 20 is cooled in countercurrent heat exchange with the nitrogen waste stream at 22 and the oxygen product in 24, water vapor and $CO_2$ are frozen on the surface of the heat exchange passage 20. After a predetermined period of time, e.g. 7½ minutes, the reversing valve 16 actuates to direct the feed air to the passage 22 previously occupied by the nitrogen waste stream, and the low pressure nitrogen waste stream flows through the passage 20 previously occupied by the air stream, sublimating and evaporating the frozen deposits of $CO_2$ and water vapor.

In a typical plant, the heat exchanger is designed so that a complete cycle occurs every 15 minutes.

A portion, e.g. 4% by volume, of the feed air is withdrawn from the exchanger at a tap point 28, with a temperature of about 198° R., and is passed via check valve 26 through a gel trap 30 which can contain silica gel, charcoal, or a molecular sieve, to remove the last traces of $CO_2$, and the air is then further cooled in heat exchange passage 32 of the fractionating device 33 having a high pressure evaporating zone 44 and a low pressure evaporating zone 52, and exits at 34 at approximately 3 atmospheres and 176° R. Passage 32 extends in heat exchange relation with the bottom portion of the low pressure evaporating zone 52.

The remainder of the air feed is further cooled in passage 20 of unit C of the heat exchanger 18, exiting at 36 at about 176° R. The air stream at 34 is mixed with air feed 36, and the mixture is fed via line 38 through heat exchange passage 39 of the oxygen product evaporator 40, where a small fraction of the feed is partially condensed by evaporating the oxygen product, as further noted hereinafter.

The air mixture at 42 is fed to the bottom of the high pressure fractionating zone 44, operating at 3 atmospheres pressure. In this zone, as a result of non-adiabatic differential distillation taking place therein, oxygen-rich liquid is progressively condensed from the vapor moving upward, until pure nitrogen is taken off as overhead at 46.

The oxygen-rich liquid is withdrawn from the bottom of the high pressure fractionating zone at 48 and is throttled to 1 atmosphere pressure by liquid level control valve 50, and is fed to the low pressure fractionating zone 52 operating at 1 atmosphere pressure.

In zone 52, as a result of non-adiabatic differential distillation, nitrogen rich vapor is progressively evaporated from the descending liquid until an oxygen-rich product of up to 95% oxygen is taken off as bottoms at 54 and is fed to the product evaporator 40 via line 56. Oxygen vapor at about 173° R. exits at 58 and enters passage 24 at the cold end 59 of heat exchanger 18 in countercuurrent heat exchange relation with the air feed in passage 20. The warm oxygen product is discharged from heat exchanger 18 at 61.

It will be noted that the high pressure fractionating zone 44 in heat exchange relation with the low pressure fractionating zone 52, is substantially shorter than the zone 52; and extends for a distance intermediate the height of zone 52.

Overhead nitrogen at 46 from high pressure fractionating zone 44, is warmed to about 173° R. in heat exchange pass 60, and while still at 3 atmospheres pressure, is fed at 63 to turbine 62, where the discharge pressure of the nitrogen is reduced to 1 atmosphere, and the temperature thereof is reduced to about 142° R. at 66.

If desired, the turbine 62 may be loaded by a compressor 64 which is used to boost the pressure of the warm oxygen at 61 to oxygen product at 65.

The cold nitrogen vapor at 66 is directed to heat exchange passage 68 in the fractionating device 33, where it initially provides refrigeration to the low or 1 atmosphere fractionating zone 52, partially condensing oxygen-rich liquid, which passes downwardly in zone 52 while nitrogen containing only a small amount of oxygen is taken off as overhead at 70. This nitrogen stream is mixed with the nitrogen turbine exhaust 66, and the resulting waste nitrogen mixture stream is further warmed in heat exchange pass 68, until it exits at 72 at 173° R., and enters passage 22 at the cold end 59 of heat exchanger 18, only 3° R. colder than the feed air 36, exiting the cold end 59 of heat exchanger 18.

If liquid oxygen is desired, it may be withdrawn at 75 from line 56 through valve 74.

There is an additional difficulty with the reversing exchangers when liquid oxygen, as described above, is the desired product. Due to the mass imbalance in the return stream in the regenerator, the $\Delta T$ profile, that is, the difference in temperature between the return streams and the air feed in the exchanger upstream of the turboexpander tap at 28 is no longer constant, but the $\Delta T$ increases as the temperature of the air feed decreases. This phenomenon limits the amount of liquid which can be withdrawn as product.

This difficulty can be resolved by adding a second intermediate tap at 80 in the heat exchanger at a warmer location than the first tap at 28. Part of the feed air is withdrawn at about 260° R., and after passing through check valve 82 and gel trap 84, is expanded through turbine 85 to 1 atmosphere at about 198° R. The cold expanded air then passes through check valve assembly 86 and enters the waste stream 22 at a point 88 in the exchanger, and at approximately the point 28 where air is withdrawn for passage through the heat exchanger pass 32.

Where only oxygen-rich liquid is desired, the mixture at 38 of the cooled air stream 34 and the cooled air feed stream at 36, is fed directly to the high pressure fractionating zone 44, and the oxygen rich liquid at 54 from the low pressure fractionating zone 44 is all removed as oxygen-rich liquid product at 55, with no oxygen-rich product being passed through passage 24 of the regenerative exchanger 18.

According to a modification shown in FIG. 3, Trumpler passes, indicated at 90 and 91, provided in units B and C of the reversing exchanger, can be used instead of the air bleeds at 28 and 80. Feed air is cooled completely to 176° R. at the cold end of the heat exchanger, and exiting at 92. Then the portion which is to be cooled in heat exchange pass 32 is warmed to 198° R. in the Trumpler pass 91 of unit C and fed to heat exchange pass 92. The remaining portion of the air which is to be fed to turbine 85 is further warmed to 282° R. by passage through the second Trumpler pass 90 of unit B and fed to turbine 85. The Trumpler pass is useful in certain instances, because it eliminates the gel traps at 30 and 84, and some of the check valves at 26 and 82. This decreases the cost of the equipment and the maintenance, but the disadvantage is that it cannot handle load changes efficiently. Accordingly, the Trumpler pass should be used where only a constant load is maintained.

If oxygen gas only is desired, it is not necessary to tap off the air stream at 80, or use the second Trumpler pass 90, and it is not necessary to use the second turbine 85.

According to the modification shown in FIG. 4, means are provided to increase the total oxygen recovery of the fractionating device, by supplying liquid nitrogen reflux to the upper portion of the low pressure fractionating zone 52. Some nitrogen vapor at 3 atmospheres is withdrawn from line 63, prior to expansion in the turbine 62, or alternately, directly from the high pressure fractionating zone at 46. Flow control valve 94 regulates the amount of nitrogen withdrawn, with the remainder being expanded in the turbine 62. Nitrogen is condensed by passage at 95 through heat exchanger 98, in heat exchange relation at 97 with throttled oxygen-rich liquid in line 48, and is reduced in pressure in valve 96, and either fed as reflux directly to the top of the low pressure fractionating zone at 100, or alternately mixed with the turbine exhaust at 66, thereby providing increased refrigeration in the upper portion of the low pressure fractionation zone 52. The primary advantage of this modification is that it increases the total recovery of oxygen, so that essentially all of the oxygen in the feed air is recovered, reducing total power consumption for production of gaseous oxygen product, but the disadvantage is that it increases cost, and reduces the refrigeration available from the turbine 62, thereby reducing the amount of oxygen that can be recovered as liquid product.

Thus, the present invention involves several novel features. One of these features is the manner in which the heat exchange in the reversing heat exchanger 18 and the mass transfer zones in the non-adiabatic differential distillation device 33 are arranged to result in the temperature of both the waste nitrogen stream and the oxygen product stream leaving the distillation device, being at a temperature only a few degrees, that is only 3° R., below the feed air temperature at the cold end of the regenerative heat exchanger. This permits facile removal of solid carbon dioxide and water from the feed air passages by the waste stream during reversal of the feed air and waste streams. Another novel feature is the use in the system of a fractionating device having a high pressure fractionating zone and a low pressure fractionating zone wherein oxygen-rich liquid withdrawn from the high pressure fractionating zone is fed to the low pressure fractionating zone to produce an oxygen-rich product of up to 95% oxygen. A portion of the feed air passes in heat exchange relation with the lower portion of the low pressure fractionating zone, and the entire feed air mixture is passed in heat exchange relation with oxygen-rich liquid product before being fed to the high pressure fractionating zone.

The overhead nitrogen streams from both the high pressure and low pressure fractionating zones, the overhead nitrogen stream from the high pressure fractionating zone being further cooled by expansion, pass in heat exchange relation with the feed air in such fractionating zones, to maintain the low temperature difference between the nitrogen waste and oxygen product streams 22 and 24, entering, and the feed air stream exiting, at the cold end 59 of the reversing heat exchanger.

Another novel feature is the carrying out of the process to permit the use of reversing exchangers while producing liquid oxygen and gaseous oxygen products, or oxygen gas alone.

From the foregoing, it is seen that the invention provides a novel process and system for separating oxygen from air, employing a differential distillation apparatus in conjunction with a reversing regenerative heat exchanger under process conditions such that the $CO_2$ and water frozen in the feed air passages can be readily removed from the heat exchangers.

While I have described particular embodiments of the invention for purposes of illustration, it will be understood that various changes and modifications within the spirit of the invention can be made, and the invention is not to be taken as limited except by the scope of the appended claims.

What is claimed is:

1. A process for the separation of oxygen from air, which comprises:

compressing feed air containing water vapor and $CO_2$, to relatively low pressure, passing the compressed feed air stream through a first passage of a reversing heat exchanger in heat exchange relation with a nitrogen waste stream passing through a second passage of said heat exchanger, whereby water vapor and $CO_2$ in the feed air are frozen on a surface of said first heat exchange passage, reversing the two streams whereby the nitrogen waste stream flows through said first passage and said feed air stream flows through said second passage, causing sublimation or evaporation of said water vapor and said $CO_2$, at the end of this cycle, again reversing the two streams so that the compressed feed air stream passes through said first passage and the nitrogen waste stream passes through said second passage, and repeating the cycle at predetermined intervals, withdrawing a portion of the feed air stream at an intermediate point in the heat exchanger, further cooling said withdrawn portion of feed air in heat exchange relationship within a fractionating device, withdrawing the remainder of said cooled feed air stream from the cold end of said heat exchanger after complete passage therethrough, mixing said further cooled portion of feed air and said withdrawn remainder of cooled feed air stream, passing said cooled feed air mixture through a first fractionating zone in said fractionating device, whereby oxygen-rich liquid is condensed, and a nitrogen overhead is produced, withdrawing said oxygen-rich liquid from said first fractionating zone, throttling said withdrawn oxygen-rich liquid to lower pressure, passing said throttled liquid downward in a second fractionating zone in said fractionating device, whereby nitrogen vapor is formed and oxygen-rich liquid is produced, withdrawing said oxygen-rich liquid as product from said second fractionating zone, work expanding nitrogen overhead from said first fractionating zone and discharging cooled work expanded nitrogen at reduced pressure, passing said cooled work expanded nitrogen through a passage in said fractionating device in heat exchange relation with said second fractionating zone and withdrawing heat from said zone, withdrawing said nitrogen from said last mentioned passage in said fractionating device and passing said withdrawn waste nitrogen stream into the cold end of said heat exchanger through one of said first and second passages of the reversing heat exchanger as aforesaid, said heat exchange in said reversing heat exchanger and the fractionation in said fractionating device being carried out under conditions such that there is only a small temperature difference between the waste nitrogen stream entering the cold end of said heat exchanger and the cooled feed air stream withdrawn from the cold end of the heat exchanger.

2. The process as defined in claim 1, including further cooling said cooled feed air mixture, prior to passage thereof through said first fractionating zone, in heat exchange relation with at least a portion of said oxygen-rich liquid product withdrawn from said second fractionating zone, causing evaporation of gaseous oxygen from said portion of oxygen-rich liquid product.

3. The process as defined in claim 1, said withdrawal of a portion of the feed air stream at said intermediate point in said heat exchanger creating a mass imbalance in the cold portion of said heat exchanger and a temperature pinch at the cold end of the exchanger, to effect said small temperature difference between the nitrogen waste stream and the cooled feed air stream at the cold end of said exchanger, and ensuring complete sublimation of the solid $CO_2$ by the nitrogen waste stream in the respective first and second passages of said heat exchanger by passage of the nitrogen waste stream therethrough.

4. The process as defined in claim 1, said feed air being compressed to about 3 atmospheres and said nitrogen waste stream being at about 1 atmosphere pressure, and the temperature difference between the nitrogen waste stream and the cooled feed air at the cold end of the heat exchanger being about 3° R.

5. The process as defined in claim 2 including withdrawing said gaseous oxygen, passing said gaseous oxygen through a third passage in said heat exchanger in heat exchange relation with said feed air in said exchanger, and withdrawing gaseous oxygen from said exchanger as product.

6. The process as defined in claim 2, including also recovering oxygen-rich liquid as product.

7. The process as defined in claim 1, wherein said further cooling of said withdrawn portion of feed air in heat exchange relation with said fractionating device comprises passing said portion of feed air in heat exchange relation with the lower portion of said second fractionating zone.

8. The process as defined in claim 1, wherein said first and second fractionating zones are in heat exchange relation, and wherein said first fractionating zone is a high pressure zone and said second fractionating zone is a low pressure zone.

9. The process as defined in claim 8, wherein said first fractionating zone operates at a pressure of about 3 atmospheres and said second fractionating zone operates at a pressure of about 1 atmosphere.

10. The process as defined in claim 8, including first passing said nitrogen overhead from said first fractionating zone downwardly in heat exchange relation with said first fractionating zone prior to work expansion of said overhead nitrogen, withdrawing nitrogen as overhead from said second fractionating zone, and mixing said last mentioned nitrogen with said cooled work expanded nitrogen, and passing said mixture downwardly in heat exchange relation with said second fractionating zone.

11. The process as defined in claim 5, wherein said work expansion of said nitrogen is used to compress said gaseous oxygen withdrawn from said heat exchanger as product.

12. The process as defined in claim 1, including first passing the portion of feed air stream withdrawn at an intermediate point in said heat exchanger, through a gel trap to remove the last traces of $CO_2$ from said air portion.

13. The process as defined in claim 1, including withdrawing an additional portion of the feed air stream at a point in the heat exchanger at a warmer location than and upstream from the portion of the feed air stream withdrawn at an intermediate point in the exchanger, work expanding said additional portion of said feed air stream, and discharging said cooled additional portion of said feed air stream into the passage containing said nitrogen waste stream in said reversing heat exchanger.

14. The process as defined in claim 13, including passing said additional portion of the feed air stream first through a gel trap to remove all traces of $CO_2$ from said additional portion of feed air stream, prior to said work expansion thereof.

15. The process as defined in claim 1, including withdrawing a portion of nitrogen overhead from said first fractionating zone prior to expansion, condensing said withdrawn portion of nitrogen by passage thereof in heat exchange relation with throttled oxygen-rich liquid from said first fractionating zone, and feeding the resulting liquid nitrogen as reflux into the top of said first fractionating zone.

16. A process for the separation of oxygen from air, which comprises:

compressing feed air containing water vapor and $CO_2$, to relatively low pressure, passing the compressed feed air stream through a first passage of a reversing heat exchanger in heat exchange relation with a nitrogen waste stream passing through a second passage of said heat exchanger, whereby water vapor and $CO_2$ in the feed air are frozen on a surface of said first heat exchange passage, reversing the two streams whereby the nitrogen waste stream flows through said first passage and said feed air stream flows through said second passage, causing sublimation or evaporation of said water vapor and said $CO_2$, at the end of this cycle, again reversing the two streams so that the compressed feed air stream passes through said first passage and the nitrogen waste stream passes through said second passage, and repeating the cycle at predetermined intervals, withdrawing said cooled feed air stream from the cold end of said exchanger after complete passage therethrough, passing a portion of the cooled feed air stream through a Trumpler pass back through the reversing exchanger, withdrawing at least a fraction of said portion of feed air stream from said Trumpler pass at an intermediate point in said heat exchanger, further cooling said withdrawn fraction of feed air in heat exchange relation within a fractionating device, withdrawing the remainder of said cooled feed air stream from the cold end of said heat exchanger after complete passage therethrough, mixing said further cooled fraction of feed air and said withdrawn remainder of cooled feed air stream, passing said cooled feed air mixture through a first fractionating zone in said fractionating device, whereby oxygen-rich liquid is condensed, and a nitrogen overhead is produced.

withdrawing said oxygen-rich liquid from said first fractionating zone, throttling said withdrawn oxygen-rich liquid to lower pressure, passing said throttled liquid downward in a second fractionating zone in said fractionating device, whereby nitrogen vapor is formed and oxygen-rich liquid is produced, withdrawing said oxygen-rich liquid as product from said second fractionating zone, work expanding nitrogen overhead from said first fractionating zone and discharging cooled work expanded nitrogen at reduced pressure, passing said cooled work expanded introgen through a passage in said fractionating device in heat exchange relation with said second fractionating zone and withdrawing heat from said zone, withdrawing said nitrogen from said last mentioned passage in said fractionating device and passing said withdrawn waste nitrogen stream into the cold end of said heat exchanger through one of said first and second passages of the reversing heat exchanger as aforesaid, said heat exchange in said reversing heat exchanger and the fractionation in said fractionating device being carried out under conditions such that there is only a small temperature difference between the waste nitrogen stream entering the cold end of said heat exchanger and the cold feed air stream withdrawn from the cold end of the heat exchanger.

17. The process as defined in claim 16, including passing the remainder of said portion of feed air stream from said Trumpler pass through a second Trumpler pass, withdrawing said remainder of said portion of the feed air stream from second Trumpler pass at a point in the heat exchanger at a warmer location than and upstream from the portion of the feed air stream withdrawn at an intermediate point in the exchanger, passing said remainder of said portion of said feed air stream to a work expander and cooling said last mentioned feed air stream, and discharging said cooled remainder of said portion of said feed air stream into the passage containing said waste nitrogen stream in said reversing heat exchanger.

18. A process for the separation of oxygen from air which comprises:

compressing feed air to a pressure of about 3 atmospheres, passing the compressed feed air stream through a reversing valve and into a first passage of a reversing heat exchanger, passing a nitrogen waste stream through a second passage of said heat exchanger, in heat exchange relation with said feed air stream, whereby water vapor and $CO_2$ in the feed air stream are frozen on the surface of the first passage of said reversing exchanger, reversing the two streams, whereby the nitrogen waste stream flows through said first passage, causing sublimation or evaporation of said water vapor and $CO_2$, at the end of this cycle, again reversing the two streams so that the compressed feed air stream passes through said first passage and the nitrogen waste stream passes through said second passage, and repeating the cycle at predetermined intervals, withdrawing a portion of the feed air stream at an intermediate point in the exchanger, passing said withdrawn portion of feed air through a gel trap to remove traces of $CO_2$, withdrawing the remainder of said cooled feed air stream from the cold end of said exchanger after complete passage therethrough, further cooling said withdrawn portion of feed air by passage thereof in heat exchange relation with the lower end of a low pressure fractionating zone of a fractionating device, withdrawing the remainder of said cooled feed air stream from the cold end of said heat exchanger after complete passage therethrough, mixing said further cooled portion of feed air and said withdrawn remainder of cooled feed air stream, further cooling the resulting feed air mixture by heat exchange with oxygen-rich liquid product, to produce a further cooled feed air mixture, passing said further cooled feed air mixture upwardly in a high pressure fractionating zone of said fractionating device, whereby oxygen-rich liquid is condensed, and a nitrogen overhead is produced, withdrawing said oxygen-rich liquid from said high pressure fractionating zone, throttling said withdrawn oxygen-rich liquid to a lower pressure, passing said throttled oxygen-rich liquid downward in said low pressure fractionating zone, whereby nitrogen vapor is formed and oxygen-rich liquid is produced, withdrawing said oxygen-rich liquid from said low pressure fractionating zone and evaporating at least a portion of said oxygen-rich liquid by heat exchange relation with said further cooled feed air mixture as aforesaid, withdrawing nitrogen as overhead from said high pressure fractionating zone, passing said nitrogen overhead downwardly in heat exchange relation with said high pressure fractionating zone, withdrawing said overhead nitrogen and work expanding said nitrogen, withdrawing nitrogen as overhead from said low pressure fractionating zone, mixing said last mentioned nitrogen with said work expanded nitrogen, passing said last mentioned mixture downwardly in heat exchange relation with said low pressure fractionating zone, said nitrogen passed in heat exchange relation with said high pressure fractionating zone and said low pressure fractionating zone causing a non-adiabatic fractional distillation to take place in said zones, withdrawing said nitrogen mixture from heat exchange relation with said low pressure fractionating zone and passing said mixture forming said waste nitrogen stream into the cold end of said heat exchanger through one of the reversing passages thereof, passing said evaporated oxygen into a third passage of said reversing exchanger in heat exchange relation with said feed air stream, withdrawing gaseous oxygen as product and compressing said product, said work expansion of said nitrogen being used to compress said gaseous oxygen product, said heat exchange in said reversing heat exchanger and said fractionation in said fractionating device being carried out under conditions such that there is only a small temperature difference between the waste nitrogen stream and vaporized oxygen entering the cold end of the exchanger, and the cooled feed air stream exiting the cold end of the heat exchanger.

19. A system for the separation of nitrogen from air, which comprises, means for compressing feed air containing water vapor and $CO_2$ to relatively low pressure, a reversing heat exchanger comprising first and second passages, valve means for reversing the flow of feed air alternately from the first to the second passage in said heat exchanger, and vice versa, whereby water vapor and $CO_2$ in the feed air stream are frozen on the surface of one of the heat exchange passages, sublimed and evaporated by reversing the flow of the feed air stream from the first passage to the second passage and the flow of a nitrogen waste stream passing from said second passage, into said first passage, said valve means being operative to repeat the cycle at predetermined intervals, means for withdrawing a portion of the feed air stream at an intermediate point in the exchanger, a check valve, said withdrawn feed air stream passing through said check valve, a fractionating device including a first fractionating column and a second fractionating column, means for passing said withdrawn portion of feed air in heat exchange relation with the lower portion of said second fractionating column, for further cooling said withdrawn portion of feed air, means for withdrawing the remainder of said cooled feed air stream from the cold end of said heat exchanger after complete passage therethrough, means for mixing said further cooled portion of feed air and said withdrawn remainder of cooled feed air stream, means for passing said cooled feed air mixture into said first fractionating column, whereby oxygen-rich liquid is condensed, and a nitrogen overhead is produced, means for withdrawing said oxygen-rich liquid from said first fractionating zone, means for throttling said withdrawn oxygen-rich liquid to lower pressure, means for passing said throttled liquid downward in said second fractionating column, whereby nitrogen vapor is formed and oxygen-rich liquid is produced means for withdrawing sid oxygen-rich liquid as product from said second fractionating column, p1 a work expander, means for passing nitrogen overhead from said first fractionating column to said work expander and discharging cool work expanded nitrogen at reduced pressure, passage means in said second fractionating column, means for passing said cooled work expanded nitrogen through said last mentioned passage means in heat exchange relation with said second fractionating column, means for withdrawing nitrogen from said last mentioned passage and passing said withdrawn nitrogen as nitrogen waste stream into the cooled end of said heat exchanger through one of said first and second passages of the reversing heat exchanger as aforesaid.

20. The system as defined in claim 19, including evaporator means for further cooling said cooled feed air mixture, prior to passage thereof into said first fractionating column, by heat exchange with at least a protion of said oxygen-rich liquid product withdrawn from said first fractionating column, and causing evaporation of gaseous oxygen, a third passage in said reversing regenerator, means for passing said gaseous oxygen into said third passage, and means for withdrawing said gaseous oxygen from said third passage and recovering same as product.

21. The system as defined in claim 19, including a gel trap, means for initially passing said portion of feed air stream withdrawn from said exchanger, first through said gel trap, prior to passage of said portion of said air stream in heat exchange relation with said second fractionating column, to remove all traces of $CO_2$ from said portion of the feed air stream.

22. The system as defined in claim 19, wherein said first fractionating column is a high pressure column and said second fractionating column is a low pressure column, said first fractionating column extending in heat exchange relation along an intermediate portion of said second fractionating column, and including passage means in said fractionating device extending in heat exchange relation along the lower portion of said second fractionating column, said portion of feed air stream withdrawn from said exchanger being passed through said last mentioned passage means.

23. The system as defined in claim 22, including passage means in heat exchange relation with said first fractionating column, said overhead nitrogen from said first fractionating column being passed through last mentioned passage means, means for withdrawing overhead nitrogen from said second fractionating column and mixing same with the nitrogen discharge from said work expander prior to passage thereof downwardly in heat exchange relation with said second fractionating column.

24. The system as defined in claim 19, including means for withdrawing a protion of nitrogen overhead from said first fractionating column, means for reducing the pressure of said protion of nitrogen, means for passing the discharged nitrogen of reduced pressure in heat exchange relation with oxygen-rich liquid discharged from said first fractionating column, and means for introducing the resulting condensed liquid nitrogen into the top of said first fractionating column.

25. The system as defined in claim 20, including a compressor, said compressor being driven by said work expander, and means for passing the gaseous oxygen from said third passage of said heat exchanger to said compressor to produce compressed oxygen product.

26. The system as defined in claim 19, including means for withdrawing an additional portion of the feed air stream at a point in the reversing exchanger upstream from the portion of the feed air stream withdrawn at an intermediate point in the exchanger, a second check valve, means for passing said additional portion of feed air stream through said second check valve, a second expander, means for passing said additional portion of feed air stream into said second expander and cooling said additional portion of said feed air stream, a third check valve, means for passing said expanded cooled air stream from said second expander through said third check valve, and means for discharging said cooled expanded additional portion of feed air stream into said waste nitrogen stream passing through one of said passages of said reversing regenerator.

27. The system as defined in claim 26, including a second gel trap intermediate said second check valve and said second expander, and means for passing said additional portion of feed air stream first through said gel trap to remove traces of $CO_2$, prior to introduction into said second expander.

* * * * *